US006073911A

United States Patent [19]

Reiter

[11] Patent Number: 6,073,911

[45] Date of Patent: Jun. 13, 2000

[54] FUEL INJECTION VALVE WITH GUIDE BALLS FOR NEEDLE VALVE

[75] Inventor: Ferdinand Reiter, Markgroeningen, Germany

[73] Assignee: Robert Bosch GmbH, Stuttgart, Germany

[21] Appl. No.: 09/100,323

[22] Filed: Jun. 19, 1998

[30] Foreign Application Priority Data

Jun. 21, 1997 [DE] Germany ..... 197 26 382

[51] Int. Cl.[7] ..... F16K 1/00; F02M 51/00

[52] U.S. Cl. ..... 251/324; 251/129.15

[58] Field of Search ..... 251/318, 324, 251/323, 129.15, 129.21

[56] References Cited

U.S. PATENT DOCUMENTS 4,778,147 10/1988 Kozuka et al. ..... 251/129.15

5,287,997 2/1994 Rodrigue et al. ..... 251/318

FOREIGN PATENT DOCUMENTS 34 11 537 A1 10/1985 Germany .

*Primary Examiner*—Kevin Shaver
*Assistant Examiner*—Eric Keasel
*Attorney, Agent, or Firm*—Ronald E. Greigg; Edwin E. Greigg

[57] ABSTRACT

A fuel injection valve with a valve needle of a narrow guidance play of the valve needle and the guide opening of the valve housing are improved by two guide sections of the valve needle being guided by guide balls which are seated against conical faces adjacent to the two guide sections. The balls are pressed against the conical faces by use of a compression spring. The fuel injection valve is particularly suited for injecting fuel into mixture compressing internal combustion engines with externally supplied ignition.

5 Claims, 1 Drawing Sheet

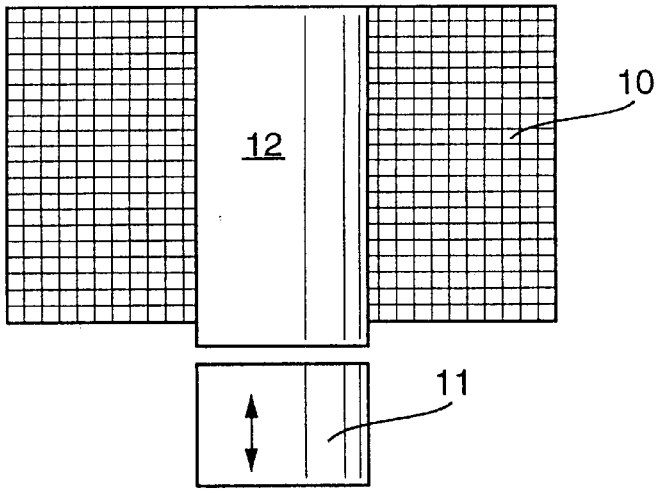
10
12
11
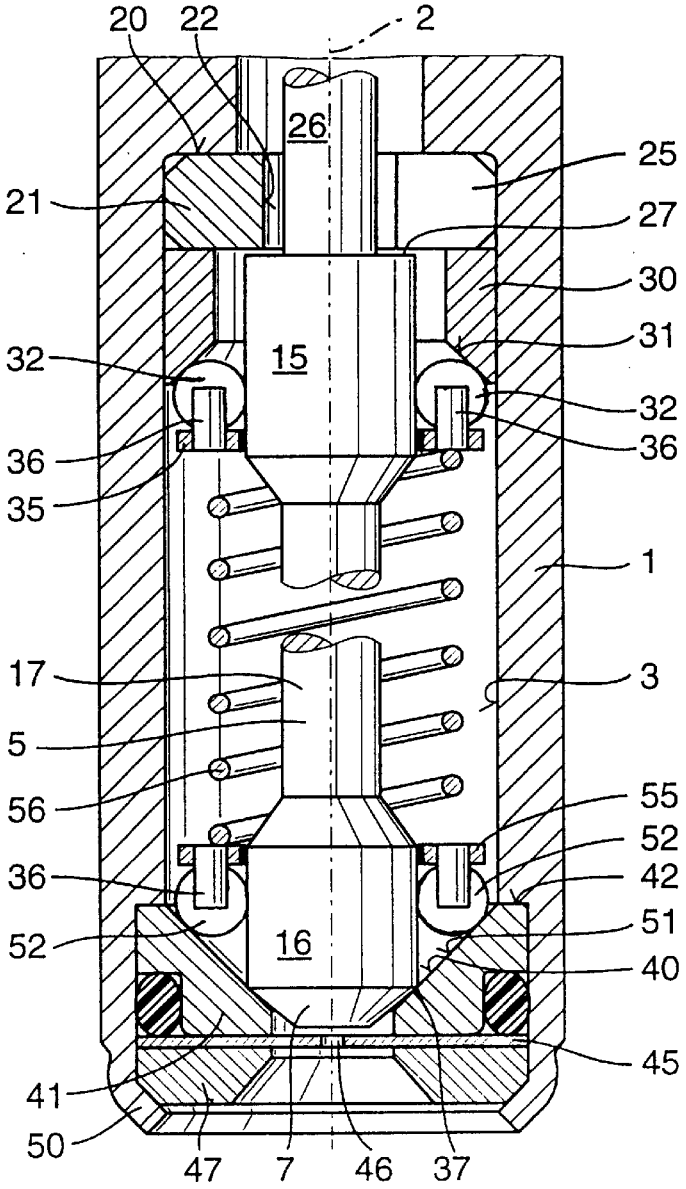
20
22
2
26
25
21
27
30
31
32
15
32
36
36
35
1
17
3
5
56
55
52
36
42
51
52
16
40
45
41
50
47
7
46
37

FUEL INJECTION VALVE WITH GUIDE BALLS FOR NEEDLE VALVE

BACKGROUND OF THE INVENTION

The invention is based on a fuel injection valve as defined hereinafter. A fuel injection valve has already been disclosed (DE 34 11 537 A1) in which the two guide sections on the valve needle and the guide faces provided for guiding the valve needle on the inside of the valve housing are machined by means of a costly paired grinding in order to achieve a narrow guidance play, which is a prerequisite for low wear and a leakproof valve.

OBJECT AND SUMMARY OF THE INVENTION

The fuel injection valve according to the invention has the advantage over the prior art that a play-free guidance of the valve needle can be easily achieved in which very low friction forces occur and the leakproofness of the valve is assured over long operating times.

Advantageous improvements and updates of the fuel injection valve include first balls that engage a circumference of a first guide section and second balls that engage a second guide section in order to guide the piston.

It is particularly advantageous to permit the first balls on the first guide section to rest against a first conical face and to permit the second balls on the second guide section to rest against a second conical face, which in a reasonably priced manner produces a precision guidance by means of geometrically simple parts.

It is likewise advantageous to embody the valve seat face flush with the second conical face and to provide it on a valve seat body that is fastened to the valve housing so that the machining is simplified.

It is furthermore advantageous to act upon the first balls and the second balls by means of a compression spring so that through the contact of the balls against the conical faces, a radial force component of the balls against the valve needle is produced, which assures a play-free guidance.

The invention will be better understood and further objects and advantages thereof will become more apparent from the ensuing detailed description of preferred embodiments taken in conjunction with the drawing.

BRIEF DESCRIPTION OF THE DRAWING

The sole FIGURE shows a cross sectional view of an exemplary embodiment of the invention in a simplified form.

DESCRIPTION OF THE PREFERRED EMBODIMENTS

The sole FIGURE partially depicts an example of an otherwise already known fuel injection valve for fuel injection systems of mixture compressing internal combustion engines with externally supplied ignition, which is embodied according to the invention. The fuel injection valve has a tubular valve housing 1, in which a longitudinal opening 3 is embodied concentric to a longitudinal valve axis 2. A rod-shaped valve needle 5 is disposed in the longitudinal opening 3, concentric to the longitudinal valve axis 2 and its downstream end is used as a valve closing body 7, for example embodied in the form of a truncated cone.

The actuation of the fuel injection valve is carried out in a known manner, for example electromagnetically. An indicated electromagnetic circuit with a magnet coil 10, an armature 11, and a core 12 is used to axially move the valve needle 5 and therefore to close the fuel injection valve or to open the valve counter to a spring force of a restoring spring, not shown. The armature 11 is connected to the end of the valve needle 5 remote from the valve closing body 7, for example by means of a weld, and is aligned with the core 12.

For the guidance of the valve needle 5 in the longitudinal opening 3, the valve needle 5 has an upstream cylindrical first guide section 15 and a downstream cylindrical second guide section 16, which adjoins the valve closing body 7, for example directly. The valve needle 5 has a valve shaft 17 with a reduced cross section between the first guide section 15 and the second guide section 16. In the longitudinal opening 3, a stop plate 21 rests against an inside shoulder 20 and has a through opening 22 from which a recess 25 leads, extending to the circumference of the stop plate 21. A section 26 of the valve needle 5 with reduced diameter, which adjoins the first guide section 15 on the upstream end, penetrates the through opening 22 with a large amount of play. When the magnet coil 10 is excited, the armature 11 is moved in the opening direction of the valve needle 5 counter to the force of the restoring spring and rests with a stop shoulder 27 on an end face of the guide section against the stop plate 21.

A guide ring 30 rests against the stop plate 21 and this guide ring encircles the first guide section 15 with radial spacing and is guided with its circumference in the longitudinal opening 3 with as little play as possible. Remote from the stop plate 21, the guide ring 30 has a first conical face 31, which tapers from the circumference of the guide ring 30 upstream toward the longitudinal valve axis 2. Between the circumference of the first guide section 15 of the valve needle 5 and the first conical face 31 of the guide ring 30, at least three first balls 32 are provided, which are evenly spaced in relation to one another; in the exemplary embodiment shown, there are four, for example. The first balls 32 rest on a first annular disk-shaped guide body 35, which is formed out of sheet metal, for example, and has catch tabs 36, which are punched-out and bent from the plane of the sheet in the direction of the longitudinal valve axis 2, and these tabs hold the first balls 32 in their position in relation to one another in the circumference direction.

A sealing seat 37 is embodied on the valve closing body 7, adjoining the second guide section 16 and when the valve is closed, this sealing seat rests in a conically embodied valve seat face 40. The valve seat face 40 is embodied on a valve seat body 41, which is inserted into the longitudinal opening 3, which is embodied as stepped, and rests against a holding step 42. On its downstream end, the valve seat body 41 rests against an injection port disk 45, which has at least one injection port 46 and is supported on the downstream end by a support ring 47, which is encompassed externally by a crimped edge 50 of the valve housing 1, which causes the valve seat body 41, the injection port disk 45, and the support ring 47 to be firmly pressed axially against the holding step 42.

A second conical face 51 that widens upstream in the direction of the longitudinal opening 3 is embodied on the valve seat body 41, for example flush with the valve seat face 40, and at least three second balls 52, with even spacing in the circumference direction in relation to one another, are disposed between this second conical face 51 and the circumference of the second guide section 16. Upstream of the second balls 52, they are engaged by a second annular disk-shaped guide body 55, which, like the first guide body 35, has catch tabs 36 that extend toward the second balls 52 and hold them evenly spaced apart from one another. A compression spring 56 is disposed between the first guide body 35 and the second guide body 55, and this spring acts on the first balls 32 in the direction of the first conical face 31 via the first guide body 35 and acts on the second balls 52 in the direction of the second conical face 51 via the second guide body 55. As a result, at the first guide section 15 and the second guide section 16, the valve needle is guided with narrow play along the longitudinal valve axis 2 by means of the first balls 32 and the second balls 52. Due to the very small contact areas between the balls 32, 52 and the guide sections 15, 16, very low friction forces are produced, which make a rapid actuation of the valve possible.

The foregoing relates to preferred exemplary embodiments of the invention, it being understood that other variants and embodiments thereof are possible within the spirit and scope of the invention, the latter being defined by the appended claims.

I claim:

1. A fuel injection valve for internal combustion engines, comprising a valve housing, said valve housing including a longitudinal valve axis, with a longitudinal opening extending along the longitudinal valve axis in the valve housing, a valve needle, said valve needle includes a first guide section (15) and a second guide section (16) for axially guiding the valve needle along the longitudinal valve axis in the valve housing, a sealing seat (7) on the valve needle, said sealing seat is disposed downstream of the second guide section (16) and cooperates with a valve seat face (40) on a valve seat body (41), a plurality of first balls (32) engage a circumference of the first guide section (15) and a plurality of second balls (52) engage the circumference of the second guide section (16) in order to guide the valve needle (5) along said valve axis, and the plurality of first balls (32) rest against the first guide section (15) at a first conical face (31) of a guide ring (30) and the second balls (52) rest against the second guide section (16) at a second conical face (51) on the valve seat body (41).

2. A fuel injection valve according to claim 1, in which the second conical face (51) is flush with the valve seat face (40).

3. A fuel injection valve according to claim 2, in which the valve seat face (40) and the second conical face (51) are embodied on said valve seat body (41) that is fastened to the valve housing (1).

4. A fuel injection valve according to claim 1, in which a first guide body (35) rests against a downstream side of the plurality of first balls (32) and a second guide body (55) rests against an upstream side of the plurality of second balls (52), and a compression spring (56) is disposed between the first guide body (35) and the second guide body (55).

5. A fuel injection valve according to claim 2, in which a first guide body (35) rests against a downstream side of the first balls (32) and a second guide body (55) rests against an upstream side of the second balls (52), and a compression spring (56) is disposed between the first guide body (35) and the second guide body (55).

* * * * *